US010669501B2

(12) United States Patent
Hobson et al.

(10) Patent No.: US 10,669,501 B2
(45) Date of Patent: Jun. 2, 2020

(54) SYNTHETIC INDUSTRIAL LUBRICANTS WITH IMPROVED COMPATIBILITY

(71) Applicant: The Lubrizol Corporation, Wickliffe, OH (US)

(72) Inventors: David M. Hobson, Cauldon (GB); Michael R. Kohut, Belper (GB); Stephen J. Gotheridge, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 15/317,617

(22) PCT Filed: Jun. 8, 2015

(86) PCT No.: PCT/US2015/034628

§ 371 (c)(1),
(2) Date: Dec. 9, 2016

(87) PCT Pub. No.: WO2015/191421

PCT Pub. Date: Dec. 17, 2015

(65) Prior Publication Data

US 2017/0137738 A1 May 18, 2017

Related U.S. Application Data

(60) Provisional application No. 62/009,377, filed on Jun. 9, 2014.

(51) Int. Cl.

| | |
|---|---|
| ***C10M 129/06*** | (2006.01) |
| ***C10M 169/04*** | (2006.01) |
| ***C10M 127/04*** | (2006.01) |
| ***C10M 129/68*** | (2006.01) |
| ***C10M 143/06*** | (2006.01) |

(52) U.S. Cl.

CPC ..... *C10M 129/06* (2013.01); *C10M 127/04* (2013.01); *C10M 129/68* (2013.01); *C10M 143/06* (2013.01); *C10M 169/04* (2013.01); *C10M 2203/06* (2013.01); *C10M 2205/026* (2013.01); *C10M 2205/0285* (2013.01); *C10M 2207/021* (2013.01); *C10M 2207/0215* (2013.01); *C10M 2207/28* (2013.01); *C10M 2207/2805* (2013.01); *C10N 2220/02* (2013.01); *C10N 2220/022* (2013.01); *C10N 2220/028* (2013.01); *C10N 2230/36* (2013.01); *C10N 2240/04* (2013.01); *C10N 2240/08* (2013.01)

(58) Field of Classification Search

CPC ..... C10M 2207/281; C10M 2207/34
USPC ..... 508/463
See application file for complete search history.

(56) References Cited

U.S. PATENT DOCUMENTS

| | | | | |
|---|---|---|---|---|
| 5,171,903 | A | 12/1992 | Koyama et al. | |
| 5,360,560 | A | 1/1994 | Kgaa | |
| 5,362,375 | A * | 11/1994 | Kubo | B23H 1/08 208/16 |
| 5,385,588 | A | 1/1995 | Brennan et al. | |
| 5,602,086 | A | 2/1997 | Le et al. | |
| 5,761,941 | A * | 6/1998 | Matsui | C10M 111/02 72/42 |
| 2006/0135378 | A1 * | 6/2006 | Takahashi | C10M 169/04 508/433 |

FOREIGN PATENT DOCUMENTS

| | | | |
|---|---|---|---|
| DE | 3929071 | A1 | 3/1991 |
| EP | 2546325 | A1 | 1/2013 |
| EP | 2698419 | A1 | 2/2014 |
| WO | 03/048276 | A1 | 6/2003 |
| WO | 2011/059626 | A1 | 5/2011 |

* cited by examiner

*Primary Examiner* — Vishal V Vasisth
(74) *Attorney, Agent, or Firm* — Iken S. Sans; Teresan W. Gilbert

(57) ABSTRACT

The invention relates to industrial gear oil compositions that have been specially designed to have improved storage stability and/or paint compatibility and/or seal compatibility. This improvement is achieved while maintaining good performance in other areas. These improvements are particularly relevant to synthetic lubricants, such as those made with polyalphaolefin (PAO) base oils. This balance of properties has been difficult to achieve in synthetic compositions where problems in the areas of storage stability, paint compatibility and/or seal compatibility of become more pronounced. The invention also relates to processes of making such compositions and methods of using the same.

5 Claims, No Drawings

SYNTHETIC INDUSTRIAL LUBRICANTS WITH IMPROVED COMPATIBILITY

CROSS REFERENCE TO RELATED APPLICATION

This application claims priority from PCT Application Serial No. PCT/US2015/034628 filed on Jun. 8, 2015, which claims the benefit of U.S. Provisional Application No. 62/009,377 filed on Jun. 9, 2014, both of which are incorporated in their entirety by reference herein.

The invention relates to industrial gear oil compositions that have been specially designed to have improved storage stability and/or paint compatibility and/or seal compatibility. This improvement is achieved while maintaining good performance in other areas. These improvements are particularly relevant to synthetic lubricants, such as those made with polyalphaolefin (PAO) base oils. This balance of properties has been difficult to achieve in synthetic compositions where problems in the areas of storage stability, paint compatibility and/or seal compatibility of become more pronounced. The invention also relates to processes of making such compositions and methods of using the same.

BACKGROUND OF THE INVENTION

Industrial lubricants are more and more shifting to synthetic base oils. These synthetic base oils pose formulation and performance problems different from those dealt with in mineral oil based compositions. There is also an ever increasing demand for higher levels of performance from lubricant users, forcing manufacturers and formulators to develop technology that can offer even small yet important improvements in performance and/or a better balance of performance properties.

It is common for synthetic industrial lubricants to include a compatibiliser, including industrial lubricants formulated with synthetic base oils. These compatibilisers are intended to maintain product stability. Some polyol esters are commonly used as compatibilisers in industrial lubricants.

However, these esters have been shown to either contribute to, or fail to mitigate, serious storage stability and/or paint compatibility and/or seal compatibility issues with the synthetic industrial lubricants in which they are used.

There is an ongoing need from improved synthetic industrial lubricants that have a better balance of storage stability and/or paint compatibility and/or seal compatibility performance.

SUMMARY OF THE INVENTION

The invention provides industrial lubricant compositions, and in particular industrial gear oil lubricant compositions, with improved storage stability and/or paint compatibility and/or seal compatibility. This improvement is achieved while maintaining good performance in other areas. These improvements are particularly noticeable in synthetic lubricants, such as those made with polyalphaolefin (PAO) base oils. This balance of properties has been difficult to achieve in synthetic compositions where problems in the areas of storage stability, paint compatibility and/or seal compatibility of become more pronounced.

The invention provides an industrial lubricant composition comprising: (a) a synthetic base oil; (b) an industrial additive package; and (c) a compatibiliser; wherein the compatibiliser comprises a saturated alcohol. In some embodiments, the saturated alcohol is branched. In still other embodiments, the composition also includes an antifoam, which may be added as a top treat.

The invention provides the described industrial lubricant compositions where the compatibiliser comprises a branched, primary, saturated alcohol.

The invention provides the described industrial lubricant compositions where the compatibiliser comprises a Guerbet alcohol.

The invention provides the described industrial lubricant compositions where the compatibiliser comprises at least one compound with the structure: $HO—CH_2—(R^1)_n—CR^2R^3R^4$ where $R^1$ is a alkylene group containing from 1 to 20 carbon atoms, n is either 0 or 1, and each of $R^2$, $R^3$ and $R^4$ are independently hydrogen or alkyl groups containing from 1 to 20 carbon atoms. In some embodiments, n is zero, $R^2$ and $R^3$ are alkyl groups and $R^4$ is hydrogen. In some of these embodiments, $R^2$ and $R^3$ contain from 4 to 14 carbon atoms, or even from 6 to 12, or even 6 and 8, or 10 and 12.

The invention provides the described industrial lubricant compositions where the alcohol contains from 12 to 28 carbon atoms, or form 14 to 26, or from 16 to 24, or from 14 to 18, or even about 16 carbon atoms.

The invention provides the described industrial lubricant compositions where the compatibiliser comprises 2-ethylhexanol, 2-butyloctanol, 2-hexyldecanol, 2-octyldodecanol, 2-decyltetradecanol, 2-dodecylhexadecanol, or any combination thereof. In some embodiments, the compatibiliser comprises 2-hexyldecanol, 2-decyltetradecanol, or any combination thereof.

The invention provides the described industrial lubricant compositions where the compatibiliser is present in the industrial gear oil composition up to 20 percent by weight. In some embodiments, the compatibiliser may be present in the described industrial lubricant compositions from 0.1, 0.2, 0.5, 1.0 or even 2.0 percent by weight up to 20, 10, 5, 3, 2.5 or even 2.0 percent by weight.

The invention provides the described industrial lubricant compositions where the synthetic base oil comprises one or more API Group IV base oils.

The invention provides the described industrial lubricant compositions where the synthetic base oil comprises one or more polyalphaolefins (PAO). Suitable PAO include PAO-2, PAO-4, PAO-5, PAO-6, PAO-7, PAO-8, PAO-40, PAO-100, or any combination thereof. Still further suitable PAO may include metallocene polyalphaolefins (mPAO), for example, the SpectraSynElite™ base stocks commercially available from ExxonMobil.

The invention provides the described industrial lubricant compositions where the composition further comprises a minor amount of one or more non-synthetic base oils. Suitable examples of non-synthetic base oils include API Group I, Group II, and/or Group III base oils.

The invention provides the described industrial lubricant compositions where the composition is an industrial gear oil lubricant composition or a hydraulic lubricant composition. In some embodiments, the composition is a paper machine lubricant.

The invention provides the described industrial lubricant compositions where the industrial lubricant additive package, comprises one or more antiwear additives and/or extreme pressure agents, one or more rust and/or corrosion inhibitors, one or more foam inhibitors, one or more detergents, one or more friction modifiers, one or more demulsifies, one or more antifoams, one or more dispersants, or any combination thereof.

The invention further provides an industrial lubricant composition comprising: (a) a synthetic base oil; (b) an industrial additive package; (c) a compatibiliser; and (d) a friction modifier; wherein the compatibiliser comprises a saturated alcohol. In some embodiments, the friction modifier includes glycerol monooleate, oleyl tartramide, or any combination thereof.

The invention provides the described industrial lubricant compositions where the industrial additive package is present from 0.1 to 5.0, or from 0.5 to 1.0, or even from 0.8 to 0.9 percent by weight. The compatibiliser may be present at any of the amounts noted above, or from 0.1 to 5.0, or from 0.5 to 3.0, or even from 1.0 to 2.5 percent by weight. The balance of the composition may be made up by synthetic base oil, for example, from 90 to 99.8 or from 96 to 99 or from 96.6 to 99.8 percent by weight.

The invention provides a process for making any of the described industrial lubricant compositions. The process includes the step of: (1) mixing the following components: (a) a synthetic base oil; (b) an industrial additive package; and (c) a compatibiliser; wherein the compatibiliser comprises a saturated alcohol; resulting in an industrial lubricant composition The invention provides a method of improving the overall storage stability and/or paint compatibility and/or seal compatibility of an industrial lubricant composition. The industrial lubricant composition includes (a) a synthetic base oil and (b) an industrial additive package and the method includes the step of: (1) adding to said industrial lubricant composition a compatibiliser wherein the compatibiliser includes a primary, saturated alcohol; resulting in an industrial lubricant composition with an improved balance of storage stability and seal compatibility. In some embodiments, the method deals with improving the storage stability of the industrial lubricant composition. In some embodiments, the method deals with improving the paint compatibility of the industrial lubricant composition. In some embodiments the method deals with improving the seal compatibility of the industrial lubricant composition. In some embodiments, the method deals with improving some combination of these properties.

DETAILED DESCRIPTION OF THE INVENTION

Various preferred features and embodiments will be described below by way of non-limiting illustration.

The invention provides an industrial lubricant composition that includes: (a) a synthetic base oil; (b) an industrial additive package; and (c) a compatibiliser; wherein the compatibiliser comprises a saturated alcohol.

The Oil of Lubricating Viscosity

The compositions of the invention include an oil of lubricating viscosity, and more specifically one or more synthetic base oils.

The oil of lubricating viscosity can be present in a major amount, for a lubricant composition, or in a concentrate forming amount, for a concentrate and/or additive composition. The industrial lubricant composition of the invention may be either lubricant compositions or concentrate and/or additive compositions.

Synthetic oils of lubricating viscosity include hydrocarbon oils such as polymerized and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated biphenyl ethers and alkylated biphenyl sulfides and the derivatives, analogs and homologs thereof or mixtures thereof. In some embodiments, the oil of lubricating viscosity used in the invention is a synthetic oil that includes polymerized polyisobutylene, and in some embodiments the oil of lubricating viscosity used in the invention is a synthetic oil that includes polymerized polyisobutylene and a polyalphaolefin.

Another synthetic oil of lubricating viscosity includes polyol esters other than the hydrocarbyl-capped polyoxyalkylene polyol as disclosed herein, dicarboxylic esters, liquid esters of phosphorus-containing acids (e.g., tricresyl phosphate, trioctyl phosphate, and the diethyl ester of decane phosphonic acid), or polymeric tetrahydrofurans. Synthetic conventional oil of lubricating viscosity also includes those produced by Fischer-Tropsch reactions and typically may be hydroisomerised Fischer-Tropsch hydrocarbons or waxes. In one embodiment, the oil of lubricating viscosity may be prepared by a Fischer-Tropsch gas-to-liquid synthetic procedure as well as other gas-to-liquid oils.

Oils of lubricating viscosity may further be defined as specified in the American Petroleum Institute (API) Base Oil Interchangeability Guidelines. The five base oil groups are as follows: Group I (sulfur content >0.03 percent by weight, and/or <90 percent by weight saturates, viscosity index 80-120); Group II (sulfur content ≤0.03 percent by weight and ≥90 percent by weight saturates, viscosity index 80-120); Group III (sulfur content ≤0.03 percent by weight and ≥90 percent by weight saturates, viscosity index ≥120); Group IV (all polyalphaolefins, or PAO, such as PAO-2, PAO-4, PAO-5, PAO-6, PAO-7 or PAO-8); and Group V (which encompasses "all others").

In some embodiments, the synthetic base oil includes one or more API Group IV base oils. In some embodiments, the synthetic base oil includes one or more polyalphaolefins (PAO). Suitable PAO include PAO-2, PAO-4, PAO-5, PAO-6, PAO-7, PAO-8, PAO-40, PAO-100, or any combination thereof. In some embodiments, the synthetic base oil includes PAO-6, PAO-40, PAO-100, or any combination thereof.

In some embodiments, the industrial lubricant composition may also include a minor amount of one or more non-synthetic base oils. Examples of these non-synthetic base oils include any of those described herein, including API Group I, Group II, or Group III base oils.

In some embodiments, these non-synthetic base oils make us less than half of the oil present in the overall industrial lubricant composition, or even less than a third, a fourth, or even a fifth of the overall industrial lubricant composition, all on a weight basis. In still other embodiments, the industrial lubricant compositions are essentially free of, or even completely free of non-synthetic base oils.

When non-synthetic base oils are also present, the oil of lubricating viscosity may include natural and synthetic oils, oil derived from hydrocracking, hydrogenation, and hydrofinishing, unrefined, refined and re-refined oils or mixtures thereof. Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and similar processes. Re-refined oils are also known as reclaimed or reprocessed oils, and are obtained by processes similar to those used to obtain refined oils. Re-refined oils are often are processed by techniques directed to removal of spent additives and oil breakdown products. Natural oils useful as the oil of lubricating viscosity include animal oils and vegetable oils (e.g., castor oil, lard oil), mineral lubricating oils such as liquid petroleum oils and solvent-treated or acid-treated mineral lubricating oils of the paraffinic, naphthenic or mixed paraffinic naphthenic types and oils derived from coal or shale or mixtures thereof.

The compositions of the present invention may include some amount of Group I, II, and III base oils, and even Group V base oils. However, in some embodiments, the lubricating oil component of the invention contains no more than 20, 10, 5, or even 1 percent by weight Group I, II, III, and/or V base oils. In other embodiments, the lubricating oil present in the compositions of the invention is at least 60, 70, 80, 90, or even 98 percent by weight Group IV base oil. In some embodiments, the lubricating oil present in the compositions of the invention is essentially only Group IV base oil, where small amounts of other types of base oils may be present but not in amounts that significantly impact the properties or performance of the overall composition.

In a fully formulated lubricant, the oil of lubricating viscosity is generally present in a major amount (i.e., an amount greater than 50 percent by weight). Typically, the oil of lubricating viscosity is present in an amount of 75 to 98 percent by weight, and often greater than 80 percent by weight of the overall composition.

The various described oils of lubricating viscosity may be used alone or in combinations. The oil of lubricating viscosity (considering all oil present) may be used in the described industrial lubricant compositions in the range of about 40 or 50 percent by weight to about 99 percent by weight, or from a minimum of 49.8, 70, 85, 93, 93.5 or even 97 up to a maximum of 99.8, 99, 98.5 or even 97 percent by weight. In other embodiments, the oil of lubricating viscosity may be used from a minimum of 40, 65, 73, 73.5, or even 81 up to a maximum of 99.8, 99.7, 98.8, 94.3, 88.5, or even 81 percent by weight.

In still other embodiments, the oil of lubricating viscosity may be used from a minimum of 50, 70, 75, 86, 86.8, or even 92.05 up to a maximum of 99.6, 99.5, 98.5, 98.4, or even 98.2 percent by weight, or from a minimum of 80, 90, 95, 96, 96.8, or even 97.05 up to a maximum of 99.6, 99.5, 99.4, or even 99.2 percent by weight, or from 50 to 99.6, from 50 to 99.5, from 70 to 99.5, from 75 to 98.5, from 86 to 98.4, from 86.8 to 98.4, or even from 92.05 to 98.2, and in still further embodiments from 80 to 99.6, from 90 to 99.6, from 95 to 99.5, from 96 to 99.4, from 96.8 to 99.4, or even from 97.05 to 99.2.

In still other embodiments, the oil of lubricating viscosity may be used from 60 to 97, or from 80 to 97, or even from 85 to 97 percent by weight. Put another way, the compositions described herein may contain at least 60, 80, or even 85 percent by weight oil of lubricating viscosity.

In concentrate compositions, typically the amount of additives and other components remains the same, but the amount of oil of lubricating viscosity is reduced, in order to make the composition more concentrated and more efficient to store and/or transport. A person skilled in the art would be able to easily adjust the amount of oil of lubricating viscosity present in order to provide a concentrate and/or additive composition.

The Compatibiliser

The compositions of the invention include a compatibiliser which includes one or more saturated alcohol.

Suitable compatibilisers include linear and branched saturated alcohols, however in some embodiments the compatibiliser includes one or more branched saturated alcohols. In some embodiments, the compatibiliser is essentially free or, or even completely free of, linear saturated alcohols.

In some embodiments, the compatibiliser includes a branched, primary, saturated alcohol. In some embodiments, the compatibiliser is essentially free or, or even completely free of, unsaturated alcohols. In some embodiments, the compatibiliser is essentially free or, or even completely free of, secondary alcohols.

In some embodiments, the compatibiliser includes one or more a Guerbet alcohols. Guerbet alcohols may be described as alcohols made via the Guerbet reaction, which was named after Marcel Guerbet. In a Guerbet reaction, a primary aliphatic alcohol is converted to its β-alkylated dimer alcohol (i.e., a branched, primary, saturated alcohol).

In some embodiments, the compatibiliser includes at least one compound with the structure: $HO—CH_2—(R^1)_n—CR^2R^3R^4$ where $R^1$ is a alkylene group containing from 1 to 20 carbon atoms, n is either 0 or 1, and each of $R^2$, $R^3$ and $R^4$ are independently hydrogen or alkyl groups containing from 1 to 20 carbon atoms. In some embodiments, n is zero, and $R^2$ and $R^3$ are alkyl groups, and $R^4$ is hydrogen. In such embodiments, $R^2$ and $R^3$ may contain from 4 to 14, or even from 6 to 12 carbon atoms. In still further embodiments, $R^2$ and $R^3$ contain 6 and 8, or 10 and 12 carbon atoms.

Suitable examples of the compatibilisers useful in the invention include 2-ethylhexanol, 2-butyloctanol, 2-hexyldecanol, 2-octyldodecanol, 2-decyltetradecanol, 2-dodecylhexadecanol, or any combination thereof. These type of alcohols are commercially available from Sasol and marketed as ISOFOL® alcohols.

In some embodiments, the compatibiliser includes 2-hexyldecanol, 2-decyltetradecanol, or any combination thereof. In some embodiments, the compatibiliser includes 2-hexyldecanol. In some embodiments, the compatibiliser includes 2-decyltetradecanol.

The compatibiliser may be present in the industrial lubricant composition at 2 percent by weight or more. In some embodiments, the compatibiliser is present from 2 to 20 or even 2 to 10 percent by weight in the industrial lubricant composition.

The Industrial Additive Package

The compositions of the invention include an industrial additive package, which may also be referred to as an industrial lubricant additive package. In other words, the compositions of the invention are designed to be industrial lubricants, or additive packages for making the same. The present invention does not relate to automotive gear lubricants or other lubricating compositions.

In some embodiments, the industrial lubricant additive package includes a demulsifier, a dispersant, and a metal deactivator. Any combination of conventional additive packages designed for industrial application may be used. The invention, in some embodiments, specifies the additive package is essentially free, if not completely free of, the compatibiliser described herein, or at least do not contain the type of compatibiliser specified by the invention in the amounts specified.

The additives which may be present in the industrial additive package include a foam inhibitor, a demulsifier, a pour point depressant, an antioxidant, a dispersant, a metal deactivator (such as a copper deactivator), an antiwear agent, an extreme pressure agent, a viscosity modifier, or some mixture thereof. The additives may each be present in the range from 50, 75, 100 or even 150 ppm up to 5, 4, 3, 2 or even 1.5 percent by weight, or from 75 ppm to 0.5 percent by weight, from 100 ppm to 0.4 percent by weight, or from 150 ppm to 0.3 percent by weight, where the percent by weight values are with regards to the overall lubricant composition. In other embodiments, the overall industrial additive package is present from 1 to 20, or from 1 to 10 percent by weight of the overall lubricant composition. However, it is noted that some additives, including viscosity modifying polymers, which may alternatively be considered as part of the base fluid, may be present in higher amounts including up to 30, 40, or even 50% by weight when considered separate from the base fluid. The additives may be used alone or as mixtures thereof.

The compositions of the invention may also include antifoams, also known as foam inhibitors, which include but are not limited to organic silicones and non-silicon foam inhibitors. Examples of organic silicones include dimethyl silicone and polysiloxanes. Examples of non-silicon foam inhibitors include but are not limited to polyethers, polyacrylates and mixtures thereof as well as copolymers of ethyl acrylate, 2-ethylhexylacrylate, and optionally vinyl acetate. In some embodiments, the antifoam is a polyacrylate. Antifoams may be present in the composition from 0.001 to 0.012 or 0.004 pbw or even 0.001 to 0.003 pbw.

The compositions of the invention may also include demulsifiers, which include but are not limited to derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments, the demulsifiers are polyethers. Demulsifiers may be present in the composition from 0.002 to 0.2 pbw.

The compositions of the invention may also include pour point depressants, which include but are not limited to esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The compositions of the invention may also include a rust inhibitor, other than some of the additives described above. Suitable rust inhibitors include hydrocarbyl amine salts of dialkyldithiophosphoric acid, hydrocarbyl amine salts of hydrocarbyl arenesulphonic acid, fatty carboxylic acids or esters thereof, an ester of a nitrogen-containing carboxylic acid, an ammonium sulfonate, an imidazoline, mono-thio phosphate salts or esters, or any combination thereof; or mixtures thereof. Examples of hydrocarbyl amine salts of dialkyldithiophosphoric acid of the invention include but are not limited to those described above, as well as the reaction product(s) of diheptyl or dioctyl or dinonyl dithiophosphoric acids with ethylenediamine, morpholine or Primene™ 81R or mixtures thereof. Suitable hydrocarbyl amine salts of hydrocarbyl arenesulphonic acids used in the rust inhibitor package of the invention are represented by the formula:

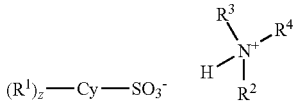

(V)

wherein Cy is a benzene or naphthalene ring. $R^1$ is a hydrocarbyl group with about 4 to about 30, preferably about 6 to about 25, more preferably about 8 to about 20 carbon atoms. z is independently 1, 2, 3, or 4 and most preferably z is 1 or 2. $R^2$, $R^3$ and $R^4$ are the same as described above. Examples of hydrocarbyl amine salts of hydrocarbyl arenesulphonic acid of the invention include but are not limited to the ethylenediamine salt of dinonylnaphthalene sulfonic acid. Examples of suitable fatty carboxylic acids or esters thereof include glycerol monooleate and oleic acid. An example of a suitable ester of a nitrogen-containing carboxylic acid includes oleyl sarcosine. The rust inhibitors may be present in the range from 0.02 to 0.2, from 0.03 to 0.15, from 0.04 to 0.12, or from 0.05 to 0.1 percent by weight of the lubricating oil composition. The rust inhibitors of the invention may be used alone or in mixtures thereof.

The compositions of the invention may also include a metal deactivator. Metal deactivators are used to neutralise the catalytic effect of metal for promoting oxidation in lubricating oil. Suitable metal deactivators include but are not limited to triazoles, tolyltriazoles, a thiadiazole, or combinations thereof, as well as derivatives thereof. Examples include derivatives of benzotriazoles other than those described above, benzimidazole, 2-alkyldithiobenzimidazoles, 2-alkyldithiobenzothiazoles, 2-(N,N'-dialkyldithio-carbamoyl)benzothiazoles, 2,5-bis(alkyl-dithio)-1,3,4-thiadiazoles, 2,5-bis(N,N'-dialkyldithiocarbamoyl)-1,3,4-thiadiazoles, 2-alkyldithio-5-mercapto thiadiazoles or mixtures thereof. These additives may be used from 0.01 to 0.25 percent by weight in the overall composition.

In some embodiments, the metal deactivator is a hydrocarbyl substituted benzotriazole compound. The benzotriazole compounds with hydrocarbyl substitutions include at least one of the following ring positions 1- or 2- or 4- or 5- or 6- or 7-benzotriazoles. The hydrocarbyl groups contain about 1 to about 30, preferably about 1 to about 15, more preferably about 1 to about 7 carbon atoms, and most preferably the metal deactivator is 5-methylbenzotriazole used alone or mixtures thereof. The metal deactivators may be present in the range from 0.001 to 0.5, from 0.01 to 0.04 or from 0.015 to 0.03 pbw of the lubricating oil composition. Metal deactivators may also be present in the composition from 0.002 or 0.004 to 0.02 pbw. The metal deactivator may be used alone or mixtures thereof.

The compositions of the invention may also include antioxidants, including (i) an alkylated diphenylamine, and (ii) a substituted hydrocarbyl mono-sulfide. In some embodiments, the alkylated diphenylamines of the invention are bis-nonylated diphenylamine and bis-octylated diphenylamine. In some embodiments, the substituted hydrocarbyl monosulfides include n-dodecyl-2-hydroxyethyl sulfide, 1-(tert-dodecylthio)-2-propanol, or combinations thereof. In some embodiments, the substituted hydrocarbyl monosulfide is 1-(tert-dodecylthio)-2-propanol. The antioxidant package may also include sterically hindered phenols. Examples of suitable hydrocarbyl groups for the sterically hindered phenols include but are not limited to 2-ethylhexyl or n-butyl ester, dodecyl or mixtures thereof. Examples of methylene-bridged sterically hindered phenols include but are not limited to 4,4'-methylene-bis(6-tert-butyl o-cresol), 4,4'-methylene-bis(2-tert-amyl-o-cresol), 2,2'-methylene-bis(4-methyl-6-tert-butylphenol), 4,4'-methylene-bis(2,6-di-tertbutylphenol) or mixtures thereof.

The compositions of the invention may also include nitrogen-containing dispersants, for example, a hydrocarbyl substituted nitrogen containing additive. Suitable hydrocarbyl substituted nitrogen containing additives include ashless dispersants and polymeric dispersants. Ashless dispersants are so-named because, as supplied, they do not contain metal and thus do not normally contribute to sulfated ash when added to a lubricant. However, they may, of course, interact with ambient metals once they are added to a lubricant which includes metal-containing species. Ashless dispersants are characterized by a polar group attached to a relatively high molecular weight hydrocarbon chain. Examples of such materials include succinimide dispersants, Mannich dispersants, and borated derivatives thereof.

The compositions of the invention may also include sulfur-containing compounds. Suitable sulfur-containing compounds include sulfurized olefins and polysulfides. The sulfurized olefin or polysulfides may be derived from isobutylene, butylene, propylene, ethylene, or some combination thereof. In some examples, the sulfur-containing compound is a sulfurized olefin derived from any of the natural oils or synthetic oils described above, or even some combination thereof. For example, the sulfurized olefin may be derived from vegetable oil.

The compositions of the invention may also include phosphorus containing compound, such as a fatty phopshite. The phosphorus containing compound can include a hydrocarbyl phosphite, a phosphoric acid ester, an amine salt of a phosphoric acid ester, or any combination thereof. In some embodiments, the phosphorus containing compound includes a hydrocarbyl phosphite, an ester thereof, or a combination thereof. In some embodiments, the phosphorus containing compound includes a hydrocarbyl phosphite. In some embodiments, the hydrocarbyl phosphite is an alkyl phosphite. By alkyl, it is meant an alkyl group containing only carbon and hydrogen atoms, however, either saturated or unsaturated alkyl groups are contemplated or mixtures thereof. In some embodiments, the phosphorus containing compound includes an alkyl phosphite that has a fully saturated alkyl group. In some embodiments, the phosphorus containing compound includes an alkyl phosphite that has an alkyl group with some unsaturation, for example, one double bond between carbon atoms. Such unsaturated alkyl groups may also be referred to as alkenyl groups, but are included within the term "alkyl group" as used herein unless otherwise noted. In some embodiments, the phosphorus containing compound includes an alkyl phosphite, a phosphoric acid ester, an amine salt of a phosphoric acid ester, or any combination thereof. In some embodiments, the phosphorus containing compound includes an alkyl phosphite, an ester thereof, or a combination thereof. In some embodiments, the phosphorus containing compound includes an alkyl phosphite. In some embodiments, the phosphorus containing compound includes an alkenyl phosphite, a phosphoric acid ester, an amine salt of a phosphoric acid ester, or any combination thereof. In some embodiments, the phosphorus containing compound includes an alkenyl phosphite, an ester thereof, or a combination thereof. In some embodiments, the phosphorus containing compound includes an alkenyl phosphite. In some embodiments, the phosphorus containing compound includes dialkyl hydrogen phosphites. In some embodiments, the phosphorus-containing compound is essentially free of, or even completely free of, phosphoric acid esters and/or amine salts thereof. In some embodiments, the phosphorus-containing compound may be described as a fatty phosphite. Suitable phosphites include those having at least one hydrocarbyl group with 4 or more, or 8 or more, or 12 or more, carbon atoms. Typical ranges for the number of carbon atoms on the hydrocarbyl group include 8 to 30, or 10 to 24, or 12 to 22, or 14 to 20, or 16 to 18. The phosphite may be a mono-hydrocarbyl substituted phosphite, a di-hydrocarbyl substituted phosphite, or a tri-hydrocarbyl substituted phosphite. In one embodiment, the phosphite is sulphur-free i.e., the phosphite is not a thiophosphite. The phosphite having at least one hydrocarbyl group with 4 or more carbon atoms may be represented by the formulae:

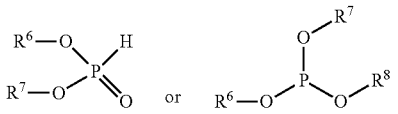

wherein at least one of $R^6$, $R^7$ and $R^8$ may be a hydrocarbyl group containing at least 4 carbon atoms and the other may be hydrogen or a hydrocarbyl group. In one embodiment, $R^6$, $R^7$ and $R^8$ are all hydrocarbyl groups. The hydrocarbyl groups may be alkyl, cycloalkyl, aryl, acyclic or mixtures thereof. In the formula with all three groups $R^6$, $R^7$ and $R^8$, the compound may be a tri-hydrocarbyl substituted phosphite i.e., $R^6$, $R^7$ and $R^8$ are all hydrocarbyl groups and in some embodiments may be alkyl groups. The alkyl groups may be linear or branched, typically linear, and saturated or unsaturated, typically saturated. Examples of alkyl groups for $R^6$, $R^7$ and $R^8$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof. In some embodiments, the fatty phosphite component of the invention, and/or the composition overall is essentially free of, or even completely free of phosphoric acid ester and/or amine salts thereof. In some embodiments, the fatty phosphite comprises an alkenyl phosphite or esters thereof, for example, esters of dimethyl hydrogen phosphite. The dimethyl hydrogen phosphite may be esterified, and in some embodiments transesterified, by reaction with an alcohol, for example, oleyl alcohol.

The compositions of the invention may also include one or more phosphorous amine salts, but in amounts such that the additive package, or in other embodiments the resulting industrial lubricant compositions, contains no more than 1.0 percent by weight of such materials, or even no more than 0.75 or 0.6 percent by weight. In other embodiments, the industrial lubricant additive packages, or the resulting industrial lubricant compositions, are essentially free of or even completely free of phosphorous amine salts.

The compositions of the invention may also include one or more antiwear additives and/or extreme pressure agents, one or more rust and/or corrosion inhibitors, one or more foam inhibitors, one or more demulsifiers, or any combination thereof.

In some embodiments, the industrial lubricant additive packages, or the resulting industrial lubricant compositions, are essentially free of or even completely free of phosphorous amine salts, dispersants, or both.

In some embodiments, the industrial lubricant additive packages, or the resulting industrial lubricant compositions, include a demulsifier, a corrosion inhibitor, a friction modifier, or combination of two or more thereof. In some embodiments, the corrosion inhibitor includes a tolyltriazole. In still other embodiments, the industrial additive packages, or the resulting industrial lubricant compositions, include one or more sulfurized olefins or polysulfides; one or more phosphorus amine salts; one or more thiophosphate esters, one or more thiadiazoles, tolyltriazoles, polyethers, and/or alkenyl amines; one or more ester copolymers; one or more carboxylic esters; one or more succinimide dispersants, or any combination thereof.

The industrial lubricant additive package may be present in the overall industrial lubricant from 1 to 5 percent by weight, or in other embodiments from 1, 1.5, or even 2 percent by weight up to 2, 3, 4, 5, 7 or even 10 percent by weight. Amounts of the industrial gear additive package that may be present in the industrial gear concentrate compositions of the invention are the corresponding amounts to the weight percent above, where the values are considered without the oil present (i.e., they may be treated as pbw values along with the actual amount of oil present).

The compositions of the invention may also include a derivative of a hydroxy-carboxylic acid. Suitable acids may include from 1 to 5 or 2 carboxy groups or from 1 to 5 or 2 hydroxy groups. In some embodiments, the friction modifier is derivable from a hydroxy-carboxylic acid represented by the formula:

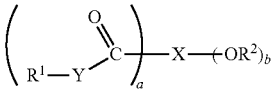

wherein: a and b may be independently integers of 1 to 5, or 1 to 2; X may be an aliphatic or alicyclic group, or an aliphatic or alicyclic group containing an oxygen atom in the carbon chain, or a substituted group of the foregoing types, said group containing up to 6 carbon atoms and having a+b available points of attachment; each Y may be independently —O—, >NH, or >$NR^3$ or two Y's together representing the nitrogen of an imide structure $R^4$—N< formed between two carbonyl groups; and each $R^3$ and $R^4$ may be independently hydrogen or a hydrocarbyl group, provided that at least one $R^1$ and $R^3$ group may be a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—$R^1$ groups, and further provided that at least on $R^2$ is hydrogen. The hydroxy-carboxylic acid is reacted with an alcohol and/or an amine, via a condensation reaction, forming the derivative of a hydroxy-carboxylic acid, which may also be referred to herein as a friction modifier additive. In one embodiment, the hydroxy-carboxylic acid used in the preparation of the derivative of a hydroxy-carboxylic acid is represented by the formula:

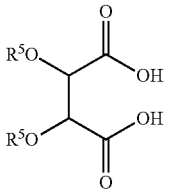

wherein each $R^5$ is independently H or a hydrocarbyl group, or wherein the $R^5$ groups together form a ring. In one embodiment, where $R^5$ is H, the condensation product is optionally further functionalized by acylation or reaction with a boron compound. In another embodiment, the friction modifier is not borated. In any of the embodiments above, the hydroxy-carboxylic acid may be tartaric acid, citric acid, or combinations thereof, and may also be a reactive equivalent of such acids (including esters, acid halides, or anhydrides). The resulting friction modifiers may include imide, di-ester, di-amide, or ester-amide derivatives of tartaric acid, citric acid, or mixtures thereof. In one embodiment, the derivative of hydroxycarboxylic acid includes an imide, a di-ester, a di-amide, an imide amide, an imide ester or an ester-amide derivative of tartaric acid or citric acid. In one embodiment, the derivative of hydroxycarboxylic acid includes an imide, a di-ester, a di-amide, an imide amide, an imide ester or an ester-amide derivative of tartaric acid. In one embodiment, the derivative of hydroxycarboxylic acid includes an ester derivative of tartaric acid. In one embodiment, the derivative of hydroxycarboxylic acid includes an imide and/or amide derivative of tartaric acid. The amines used in the preparation of the friction modifier may have the formula RR'NH wherein R and R' each independently represent H, a hydrocarbon-based radical of 1 or 8 to 30 or 150 carbon atoms, that is, 1 to 150 or 8 to 30 or 1 to 30 or 8 to 150 atoms. Amines having a range of carbon atoms with a lower limit of 2, 3, 4, 6, 10, or 12 carbon atoms and an upper limit of 120, 80, 48, 24, 20, 18, or 16 carbon atoms may also be used. In one embodiment, each of the groups R and R' has 8 or 6 to 30 or 12 carbon atoms. In one embodiment, the sum of carbon atoms in R and R' is at least 8. R and R' may be linear or branched. The alcohols useful for preparing the friction modifier will similarly contain 1 or 8 to 30 or 150 carbon atoms. Alcohols having a range of carbon atoms from a lower limit of 2, 3, 4, 6, 10, or 12 carbon atoms and an upper limit of 120, 80, 48, 24, 20, 18, or 16 carbon atoms may also be used. In certain embodiments, the number of carbon atoms in the alcohol-derived group may be 8 to 24, 10 to 18, 12 to 16, or 13 carbon atoms. The alcohols and amines may be linear or branched, and, if branched, the branching may occur at any point in the chain and the branching may be of any length. In some embodiments, the alcohols and/or amines used include branched compounds, and in still other embodiments, the alcohols and amines used are at least 50%, 75% or even 80% branched. In other embodiments, the alcohols are linear. In some embodiments, the alcohol and/or amine have at least 6 carbon atoms. Accordingly, certain embodiments of the invention employ the product prepared from branched alcohols and/or amines of at least 6 carbon atoms, for instance, branched $C_{6-18}$ or $C_{8-18}$ alcohols or branched $C_{12-16}$ alcohols, either as single materials or as mixtures. Specific examples include 2-ethylhexanol and isotridecyl alcohol, the latter of which may represent a commercial grade mixture of various isomers. Also, certain embodiments of the invention employ the product prepared from linear alcohols of at least 6 carbon atoms, for instance, linear $C_{6-18}$ or $C_{8-18}$ alcohols or linear $C_{12-16}$ alcohols, either as single materials or as mixtures. The tartaric acid used for preparing the tartrates, tartrimides, or tartramides of the invention can be the commercially available type (obtained from Sargent Welch), and it exists in one or more isomeric forms such as d-tartaric acid, l-tartaric acid, d,l-tartaric acid or meso-tartaric acid, often depending on the source (natural) or method of synthesis (e.g., from maleic acid). These derivatives can also be prepared from functional equivalents to the diacid readily apparent to those skilled in the art, such as esters, acid chlorides, anhydrides, etc. In other embodiments, the friction modifier includes glycerol monooleate.

In some embodiments, the additive package includes one or more corrosion inhibitors, one or more dispersants, one or more antiwear and/or extreme pressure additives, one or more extreme pressure agents, one or more antifoam agents, one or more detergents, and optionally some amount of base oil or similar solvent as a diluent. In some embodiments, the additive package includes at least one friction modified and at least one demulsifier, and optionally one or more additional additives present as well.

The additional additives may be present in the overall industrial gear lubricant composition from 0.1 to 30 percent by weight, or from a minimum level of 0.1, 1 or even 2 percent by weight up to a maximum of 30, 20, 10, 5, or even 2 percent by weight, or from 0.1 to 30, from 0.1 to 20, from 1 to 20, from 1 to 10, from 1 to 5, or even about 2 percent by weight. These ranges and limits may be applied to each individual additional additive present in the composition, or to all of the additional additives present.

INDUSTRIAL APPLICATION

As noted above, the invention includes both industrial lubricant compositions and industrial additive concentrate compositions that may be used to make industrial lubricant compositions. In some embodiments, the industrial lubricant compositions of the invention are industrial gear lubricant compositions. In some embodiments, the industrial lubricant compositions of the invention are hydraulic lubricant compositions.

The various ranges for the components described above can be applied to concentrate compositions by maintaining the same relative ratios between components (b) and (c), while adjustment the amount of (a), (that is the amount of (a) will be much lower in a concentrate composition compared to a lubricant composition). In such embodiments, the percent by weight values for components (b) and (c) may be treated as parts by weight (pbw), with oil making up the balance of the concentrate composition, including anywhere from 0 or 0.1 or 0.5 or even 1 pbw up to 10, 20, 30 or even 40 or 50 pbw oil and/or base fluid.

The invention provides a process for making any of the described industrial lubricant compositions. The process includes the step of: (1) mixing the following components: (a) a synthetic base oil; (b) an industrial additive package; and (c) a compatibiliser; wherein the compatibiliser comprises a saturated alcohol; resulting in an industrial lubricant composition. Such processes include mixing the described components together. No particular order or means of addition is believed to significantly impact the results.

The invention provides a method of improving the overall storage stability and/or paint compatibility and/or seal compatibility of an industrial lubricant composition. The industrial lubricant composition includes (a) a synthetic base oil and (b) an industrial additive package and the method includes the step of: (1) adding to said industrial lubricant composition a compatibiliser wherein the compatibiliser includes a primary, saturated alcohol; resulting in an industrial lubricant composition with an improved balance of storage stability and seal compatibility.

In some embodiments, the method deals with improving the storage stability of the industrial lubricant composition. In some embodiments, the method deals with improving the paint compatibility of the industrial lubricant composition. In some embodiments, the method deals with improving the seal compatibility of the industrial lubricant composition. In some embodiments, the method deals with improving some combination of these properties. The improvements noted above are in regards to the same industrial lubricant composition that is missing component (b) and/or using an alternative for component (b), for example, the ester materials used widely in the industry today. Such comparative industrial lubricant compositions can be expected to be lacking in at least one of the areas note above.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: (i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); (ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); (iii) hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known some of the materials described above may interact in the final formulation, so that components of the final formulation may be different from those initially added. For instance, metal ions (of, e.g., a detergent) can migrate to other acidic or anionic sites of other molecules. The products formed thereby, including the products formed upon employing the composition of the invention in its intended use, may not be susceptible of easy description. Nevertheless, all such modifications and reaction products are included within the scope of the invention; the invention encompasses the composition prepared by admixing the components described above.

The invention may be better understood with reference to the following non-limiting examples.

EXAMPLES

A set of examples is prepared and tested in order to demonstrate the benefits of the invention. Each sample tested is prepared by mixing an compatibiliser to be evaluated into a base fluid (either a ISO 150 base fluid containing a PAO 6 and a PAO 40, or as ISO 460 base fluid containing a PAO 6 and a PAO 100, as indicated in the table below). The amount of ester in each example is also noted in the table below.

The first evaluation focuses on storage stability. Once prepared each sample is stored at −18°, 0° C., room temperature (RT) and 65° C. and visually rated at start of test (SOT) and thereafter at intervals of 1 week, 4 weeks and 8 weeks (EOT). At the end of the test, the collected results are compiled and the sample is given a pass rating or a fail rating.

The second evaluation focuses on paint compatibility. Generally, only examples with good storage stability are tested in for paint compatibility. The samples tested are evaluated using the Siemens MD Rev.14 paint test, also referred to as the Flender Gear Units test specification for oil compatibility with the gear inside in the coating.

The third evaluation focuses on seal compatibility. Generally, only examples with good storage stability and paint compatibility are tested in for seal compatibility. The samples tested are evaluated using the Freudenberg Sealing Technologies internal test procedure FB 73 11 008 for static seal stability.

Each example is prepared using the same industrial additive package at the treat rates noted in the table below. The industrial additive package includes corrosion inhibitors, dispersants, antiwear additives, extreme pressure agents, antifoam agents, and detergents. Each example is prepared using a different compatibiliser in order to see which compatibiliser can provide an industrial lubricant composition with suitable storage stability. The formulations of the examples and the storage stability results are summarized in the table below. For the testing, results for storage stability, paint compatibility, and seal compatibility are presented by showing the percent by weight the compatibiliser is present in the sample (without a percent symbol), the base fluid used (150 of the ISO 150 fluid and 460 for the ISO 460 fluid) and the result (P for Pass and F for Fail) in the following format: [% compatibiliser], [base fluid]; [result].

TABLE 1

| | Compatibiliser | | | | Seal Compatibility (Static Seal Data) | | |
|---|---|---|---|---|---|---|---|
| EX | (Comp) | Storage | Paint Compatibility | | 72 NBR | 75 FKM | 75 FKM |
| ID | Type: Detail | Stability | P22 | Nuvopur | 902 | 585 | 280466 |
| 1 | ESTER: Priolube ™ 2089; unsaturated polyol mixture | 7, 150: F<br>5, 460: F<br>10, 460: F | 7, 150: F | 7, 150: F | 7, 150: P | 7, 150: P | 7, 150: P |
| 2 | ESTER: Priolube ™ 3970; saturated polyol mixture | 5, 460: F<br>10, 460: F | 7, 150: F | 7, 150: F | 7, 150: P | | |
| 3 | ESTER: Nycobase ® 8103; linear saturated ester | 5, 460: F<br>10, 460: F | 7, 150: F | 7, 150: F | 7, 150: P | 7, 150: F | 7, 150: P |
| 4 | ESTER: Nycobase ® 8898; linear saturated ester | 5, 460: F<br>10, 460: F | | | | | |
| 5 | ESTER: Nycobase ® 1040X; Branched saturated esters | 5, 460: F<br>10, 460: F | | | | | |
| 6 | PIB: ~2000 MW polyisobutylene with a pour point depressant | 5, 150: F<br>15, 460: P | 5, 150: P | 5, 150: F | 4, 460: P | 4, 460: P | 4, 460: P |
| 7 | PIB: ~2000 MW polyisobutylene | 5, 150: F<br>10, 460: P | 5, 150: P | 5, 150: F | | | |
| 8 | AB: C10-C12 alkylbenzenes, C11 centered | 5, 460: F<br>10, 460: F | 5, 150: P | 5, 150: F | | | |
| 9 | AB: C10-C13 alkylbenzenes, C12 centered | 5, 460: F<br>10, 460: F | | | 10, 460: P | 10, 460: P | 10, 460: P |
| 10 | ALCOHOL: Isofol ® 16; 2-hexyl-decanol | 2, 460: P<br>5, 460: P<br>10, 460: P<br>2, 150: P<br>5, 150: P<br>10, 150: P | 2, 150: P<br>5, 150: P<br>10, 150: P | 2, 150: F<br>5, 150: P/F<br>10, 150: P/F | 5, 150: P<br>10, 150: P | 5, 150: P<br>10, 150: P | 5, 150: P<br>10, 150: P |
| 11 | ALCOHOL: Isofol ® 24; 2-decyl-tetradecanol | 2, 460: P<br>2, 150: P<br>5, 150: P<br>10, 150: P | | | | 5, 150: P<br>10, 150: P | 5, 150: P<br>10, 150: P |
| 12 | ALCOHOL: ethyl hexanol | 10, 150: P | | | | | |
| 13 | ALCOHOL: mixture of C12-C14 linear alcohols | 2, 150: P<br>10, 150: P | | | | | |

TABLE 1-continued

| Compatibiliser | | | | Seal Compatibility (Static Seal Data) | | |
|---|---|---|---|---|---|---|
| EX (Comp) | Storage | Paint Compatibility | | 72 NBR | 75 FKM | 75 FKM |
| ID Type: Detail | Stability | P22 | Nuvopur | 902 | 585 | 280466 |
| 14 ALCOHOL: mixture of linear and branched Iso-tridecanol | 2, 150: P<br>10, 150: P | | | | | |
| 15 ALCOHOL: Ocenol ® 80/85; linear oleyl alcohol | 2, 150: F<br>10, 150: P | | | | | |

The results how that only a few industrial lubricant composition examples show acceptable storage stability. Of those examples, only a select few have good paint compatibility, and even fewer still have good seal compatibility as well. Examples 10 and 11 provide the best overall balance of properties.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A gear oil lubricant composition comprising:

(a) 60 to 97 percent by weight of a polyalphaolefin (PAO) base oil;

(b) 1 to 20 percent by weight of an industrial gear additive package; and (c) 2 to 20 percent by weight of a compatibiliser that is a β-branched saturated alcohol containing from 16 to 28 carbon atoms; and wherein the industrial gear additive package comprises:

(i) one or more phosphorous containing antiwear additives;

(ii) one or more sulfurized olefin containing extreme pressure agents; and (iii) one or more demulsifiers.

2. The gear oil lubricant composition of claim 1 wherein the compatibiliser is present in the gear oil lubricant composition at 5.0 to 20 percent by weight.

3. The gear oil lubricant composition of claim 1 wherein the compatibiliser is present in the gear oil lubricant composition at 10 to 20 percent by weight.

4. The gear oil lubricant composition of claim 1 wherein the industrial gear additive package, comprises one or more rust and/or corrosion inhibitors, one or more foam inhibitors, one or more detergents, one or more friction modifiers, one or more antifoams, one or more dispersants, or any combination thereof.

5. The gear oil lubricant composition of claim 1, wherein the combatibiliser comprises 2-hexyldecanol, 2-octyldodecanol, 2-decyltetradecanol, 2-dodecylhexadecanol, or any combination thereof.

* * * * *